US005544703A

United States Patent [19]

Joël et al.

[11] Patent Number: 5,544,703

[45] Date of Patent: Aug. 13, 1996

[54] PLATE HEAT EXCHANGER

[75] Inventors: Richard Joël, Eybens; Robert Nicolas; Roussel Claude, both of Echirolles; Chopard Fabrice, Saint Martin D'Heres, all of France

[73] Assignee: Vicarb, France

[21] Appl. No.: 245,448

[22] Filed: May 18, 1994

[30] Foreign Application Priority Data

May 18, 1993 [FR] France ..... 93 06257

[51] Int. Cl.[6] ..... F28F 3/08

[52] U.S. Cl. ..... 165/167; 165/166

[58] Field of Search ..... 165/166, 167

[56] References Cited

U.S. PATENT DOCUMENTS

| | | | |
|---|---|---|---|
| 1,275,492 | 8/1918 | Sterzing | 165/166 |
| 2,834,582 | 5/1958 | Kablitz | 165/166 X |
| 2,892,618 | 6/1959 | Holm | 165/166 X |
| 2,941,787 | 6/1960 | Ramén | 165/166 X |
| 5,180,459 | 1/1993 | Bauer et al. | 156/89 |

FOREIGN PATENT DOCUMENTS

| | | |
|---|---|---|
| 0203213 | 12/1986 | European Pat. Off. . |
| 0206935 | 12/1986 | European Pat. Off. . |
| 1501653 | 11/1969 | Germany . |

*Primary Examiner*—Allen J. Flanigan
*Attorney, Agent, or Firm*—Harris Beach & Wilcox

[57] ABSTRACT

This plate heat exchanger with parallel and counterflow circulation of the heat-exchange fluids is constructed by stacking a determined number of ribbed plates (4) of the same size, clamped against one another between two flanges (1,2), said plates having openings (5,6,7,8) in their corners, defining, within the stack, supply and outlet channels respectively for the heat-exchange fluids.

The plates are made of bulk machined graphite, previously impregnated with a waterproofing material, and in particular a resin.

6 Claims, 3 Drawing Sheets

PLATE HEAT EXCHANGER

BACKGROUND OF THE INVENTION

The invention relates to a novel type of plate exchanger. It also relates to heat-exchange plates allowing the production of such an exchanger.

Current heat exchangers are divided into two main categories, namely tube exchangers, whose design is already old, and plate exchangers, which are more recent and have the feature of being easy to disassemble and alter.

In general, exchangers with plates and joints consist of a stack of a defined number of ribbed plates, of the same type, which are clamped between two flanges, in particular using tie-rods. These plates have openings at their corners which, within the stack thus constituted, define respective supply and outlet channels for the heat-exchange fluids. A circulation network is defined between two consecutive plates by virtue of the ribs, of one of the fluids, for example the hot fluid, which transmits, through the two plates, heat to the other cold heat-exchange fluid which flows in the opposite direction between the two immediately consecutive plates.

Until now, these heat-exchange plates have been made of any deep-drawable metallic material, in particular stainless steel, titanium, etc., which can exhibit relatively good heat-exchange performances while being compact. Nevertheless, it has been designed to improve the heat exchange between two successive plates and therefore resort to a material having a greater capacity for ensuring heat exchange.

Among these various materials, there is one which is an especially good conductor of heat, namely graphite. Nevertheless, it has the great drawback of having relatively poor mechanical strength so that, until now, it has not been used for producing such plates.

It has now been proposed, in order to overcome this deficiency in mechanical properties, to mold ribbed plates from a resin of the PVDF type (polyvinylidene sulfide), or from a fluorinated polymer incorporating graphite particles (see for example EP-A-0,203,213). In addition to the requirement of a specific press for obtaining this molding, obtained in the case in point by pressing, the plates obtained do not exhibit a very significant improvement in heat exchange performance, considering the insufficiency of the concentration of the graphite particles in the composite material obtained.

It has also been proposed, for producing such plates, to incorporate expanded graphite within a carbon-carbon structure, the assembly thus produced then undergoing hot pressing, so as to obtain the desired profile for said plates. However, in addition to the difficulty relating to the pressing operation, it is observed that, despite the use of graphite, the heat-exchange performance remains unsatisfactory.

SUMMARY OF THE INVENTION

The object of the invention is to provide a plate heat exchanger, made from bulk graphite in order to give very significant improvement of its heat-exchange performance, and capable of operating both in a horizontal and in a vertical position.

This plate heat exchanger with parallel and counterflow circulation of the heat-exchange fluids, is constructed by stacking a determined number of ribbed plates of the same size, clamped against one another between two flanges, said so-called heat-exchange plates having openings in their comers defining, within the stack, respective supply and outlet channels for the heat-exchange fluids.

The plates are made of machined bulk graphite, previously impregnated with a waterproofing material and in particular a resin.

In other words, the invention consists in using, as constructional material, plates of bulk graphite which are machined in bulk, this being counter to all teachings which discourage the use of such a material in view of its very low mechanical strength, in particular with respect to the pressures generated within the exchanger, which pressures can easily reach values close to $10.10^5$ to $15.10^5$ pascals. In fact, the bulk graphite plates used in the scope of the invention withstand such pressures because of their particular profile described hereinbelow.

According to the invention, at least one of the two faces of each of the plates has a profile including two distribution regions consisting of a plurality of ducts extending substantially radially over a sector from two of the openings of the plate, and a heat-exchange region, connecting the two distribution regions and including a plurality of obstacles to the progression of the fluid circulating between two adjacent plates, defining, on the one hand, a multitude of ducts connecting with the ducts of the distribution regions and, on the other hand, points of bearing of said plate on the immediately adjacent plate.

According to one very advantageous feature of the invention, the upper surface of each of the obstacles of the heat-exchange regions is planar, and the upper surface of each of said obstacles is contained in one and the same plane, which plane furthermore incorporates the upper surface of the side edge of the plate. In this way, a multitude of bearing points are created which can give the stacked plates the mechanical strength required for withstanding the pressures of the heat-exchange fluids which pass through the exchanger.

According to another feature of the invention, the two faces of one and the same plate may have different profiles, in order to obtain better thermodynamic performance for each of the heat-exchange fluids.

Thus, by choosing an expedient profile at the level of each of the plates and advantageously at the level of each of the faces of each of the plates, the plates rest on one another when they are in place in the exchanger, on the one hand, at the level of the side edge but also at the level of each of the obstacles of the heat-exchange region.

Advantageously, the obstacles of the heat-exchange regions have the shape of an ellipse, flame, "s" crescent or teardrop, this being for the purpose of optimizing the heat exchange by creating turbulence at the level of these obstacles, and by also increasing the heat exchange surface area. Furthermore, in an advantageous variant, the side face of each of the obstacles is itself ribbed in order still further to increase the heat exchange surface area and thereby the very efficiency of this heat exchange.

According to another feature of the invention, the various obstacles are distributed in a triangular or square network.

In fact, the ducts defined by the various obstacles at the level of this heat-exchange region exhibit cross-sectional variations in order to create fluid acceleration regions which are also capable of optimizing the efficiency of the heat exchange. These fluid acceleration regions are also generated by altering the depth of the profile of these various ducts.

BRIEF DESCRIPTION OF THE DRAWINGS

The manner in which the invention may be embodied and the advantages which stem therefrom will better emerge from the embodiment which follows, given by way of indication and without limitation with the aid of the attached figures.

DESCRIPTION OF THE INVENTION

Figure 1:
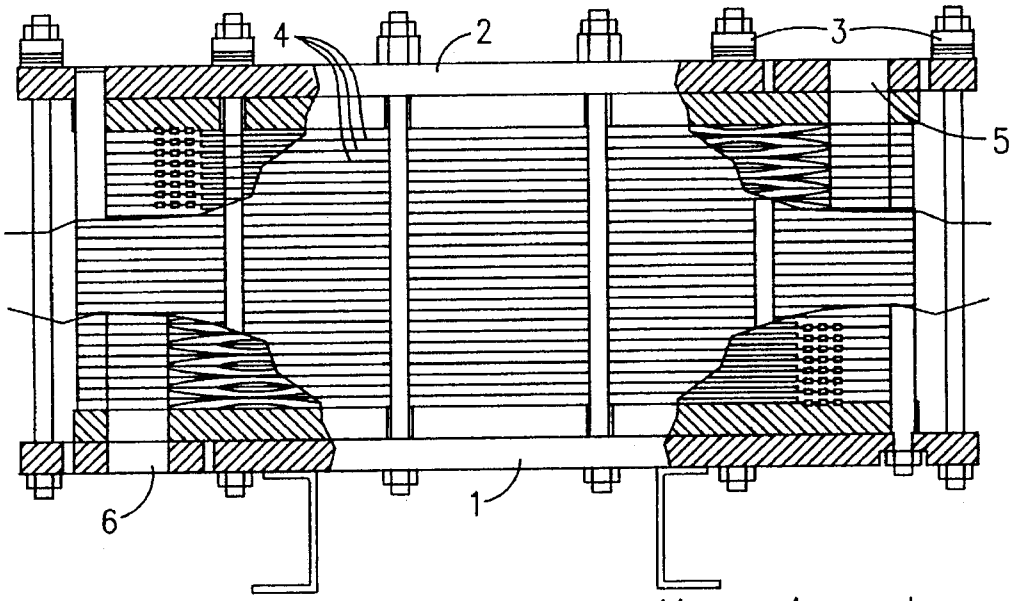
FIG. 1 is a schematic representation, partially in cross-section, of a heat exchanger according to the invention.

According to the invention, the exchanger represented in FIG. 1 is constructed by stacking a certain number of heat-exchange plates (4) made by machining bulk graphite plates previously impregnated with resin. As is known, this resin is intended to close the pores which the graphite contains. These various plates (4), cut to identical sizes, are arranged and clamped against one another between two flanges (1) and (2) and held in this state, in particular by means of tie-rods (3). A joint (13) is also positioned between each plate, which joint is advantageously made of flexible sheets of graphite or of fluorinated polymers such as PTFE (polytetrafluoroethylene), so as to retain the chemical homogeneity of the assembly. Two alternate independent circulation circuits are thus generated for the hot and cold fluids respectively.

Each of the plates includes openings (5, 6, 7 and 8) at its four corners, which openings define supply and outlet channels for the two heat-exchange fluids when said plates are superposes.

Figure 2:
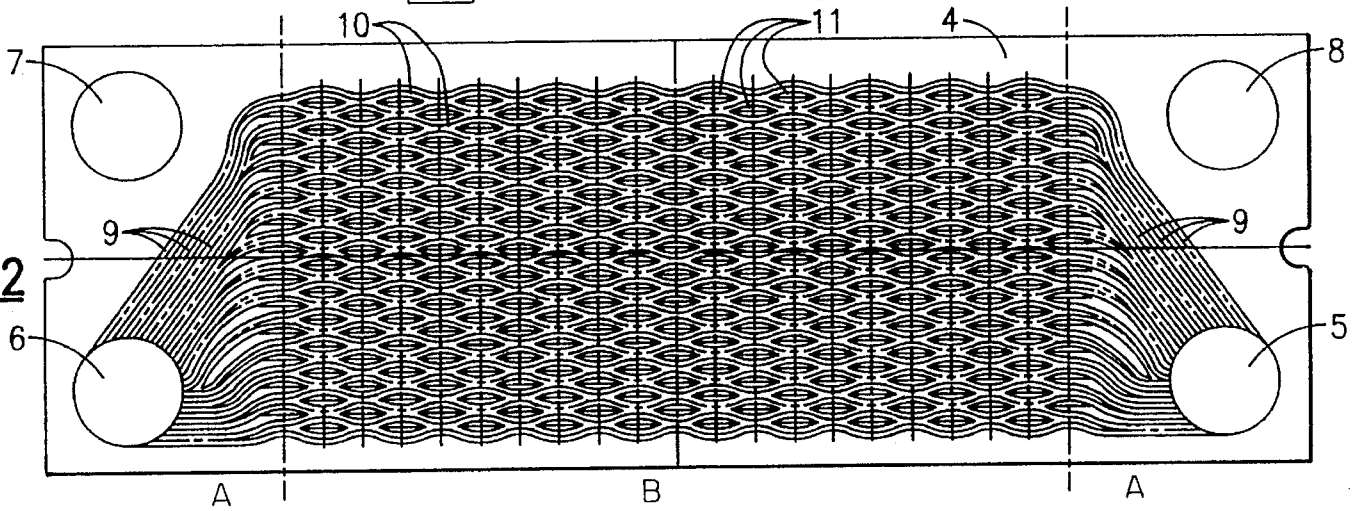
FIG. 2 is a plan view of a heat-exchange plate according to the invention.

By way of illustration, the two openings (5) and (6) of the plate represented in FIG. 2 respectively correspond to the supply and outlet of one of the heat-exchange fluids, while the openings (7) and (8) are intended for the supply and outlet of the second heat-exchange fluid at the level of the other face of the plate represented in FIG. 2.

In fact, as is known, the two heat-exchange fluids, respectively the hot fluid and the cold fluid, never enter into contact. Thus, as has already been described, two consecutive plates are jointed together by means of a joint (13) extending in a groove (12) made at the level of the periphery of each of the plates. In addition, at the level of each of the faces of one plate, the two openings corresponding to the circuit of the other face are also jointed by means of a joint (15) received in a groove (14) situated on the periphery of said openings. As for the joint (13), this joint (15) is advantageously made of flexible sheets of graphite or of fluorinated polymers (such as, for example, PTFE).

According to one essential feature of the invention, at least one of the two faces of said plates is machined in bulk, this being done by any known means and in particular by means of numerically controlled machines managing the action of shaping cutters, in order to define ducts and obstacles within this plate, respectively intended for guiding and inducing heat exchange between the hot fluid and the plate, on the one hand, and between the plate thus heated and the cold fluid, on the other hand.

In fact, and as can be observed in FIG. 2, each of the faces is subdivided into three regions, respectively two distribution regions given the general reference A and a heat-exchange region given the general reference B.

The distribution regions A consist of a plurality of ducts (9) extending substantially radially from the respective opening (5) and (6) and only over one disk sector. More specifically, these ducts have the purpose of ensuring transfer of the fluid from the supply opening (5) over the entire width of the plate, and then from the width of the plate to the outlet opening (6).

In addition, in order to achieve equal distribution of the fluid at the level of the heat-exchange region B, the ducts (9) have profiles which differ depending on their length and therefore depending on their orientation with respect to the respective openings (5,6). Thus, the cross-section of the shortest ducts is smaller than that of the longer ducts, in order just to balance the distribution of the fluid over the entire width of the plate. Also, in order to reduce the head loss, and thereby to improve the distribution, the profile of each of the ducts (9) varies progressively from the openings (5,6) to the heat-exchange region B.

The heat-exchange region B of each of the plates consists of a plurality of ducts (10), also machined from the bulk, and includes a plurality of obstacles (11), advantageously of elongate shape and distributed in a square or triangular network.

These obstacles (11) have the shape of an ellipse, flame, "S", crescent or even teardrop and are intended, on the one hand, to increase the heat-exchange surface area, but also to create turbulence regions for promoting heat exchange between the fluid and the plate. Also, by virtue of the presence of the obstacles (11), regions of reduced cross-section are created in order to generate local acceleration of the fluid which makes it possible to enhance the heat exchange, but also to increase the exchange surface area and in addition to reinforce the mechanical strength of the plate.

Figure 5:
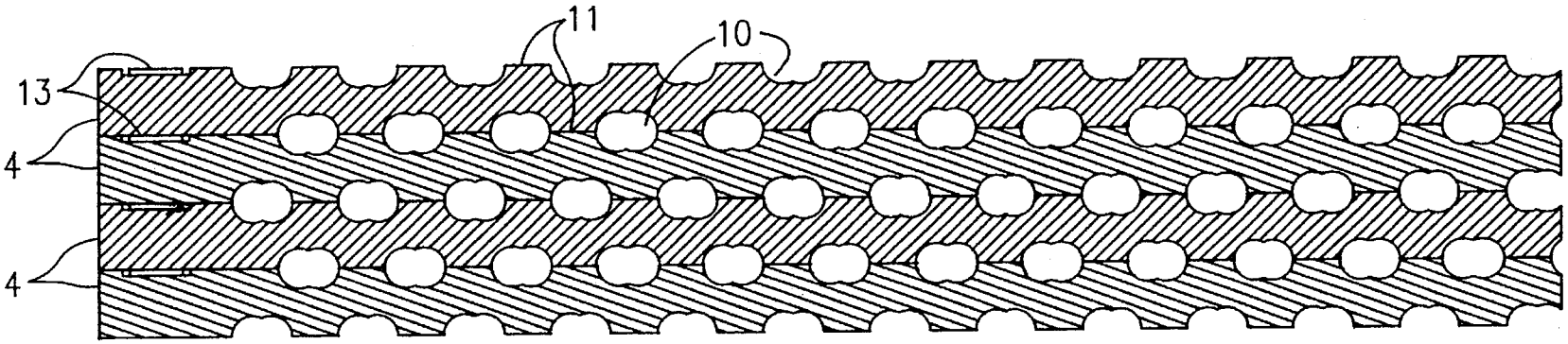
FIG. 5 is a more detailed representation of a cross-section of the plate according to the invention.
Figure 6:
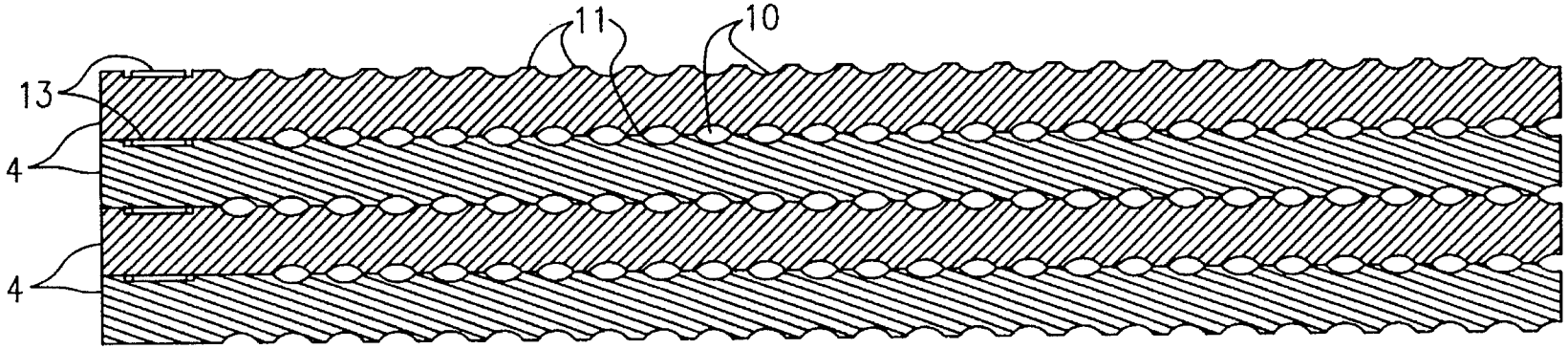
FIG. 6 is another similar sectional view made at a different location from the one in FIG. 5.

According to a feature of the invention, the obstacles (11) have an upper surface which is planar and thus capable of creating bearing points with the obstacles formed on the plate positioned opposite, in complementary fashion with the bearing surface consisting of the edges of the plates. FIGS. 5 and 6 show this mutual cooperation of the plates, creating two independent circulation networks for the two fluids and bearing on one another via said obstacles and their outer edge.

In fact, and as already stated, the mechanical strength of the assembly is increased, thus allowing the exchanger to withstand high working pressures.

According to another feature of the invention, the acceleration regions of the liquid also consist of local variations in the machining depth of the ducts (10).

The obstacles (11) either have a uniform side surface or, on the other hand, are machined so as to have microchannels intended again to increase the heat-exchange surface area and thereby the efficiency of the heat exchange.

Figure 3:
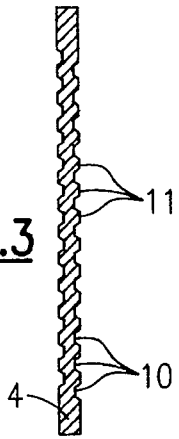
FIG. 3 is a view in cross-section of the plate in FIG. 2.
Figure 4:
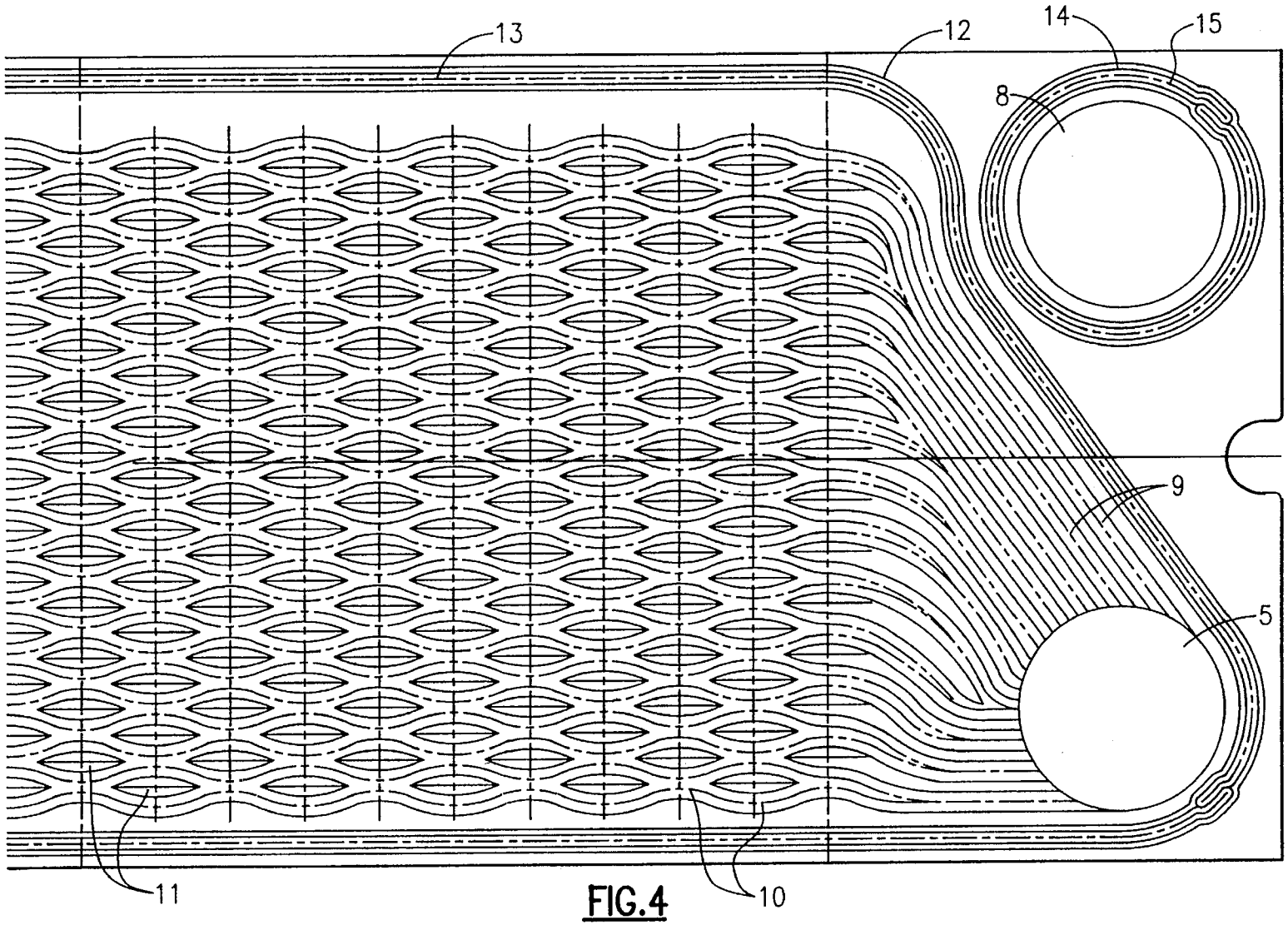
FIG. 4 is a more detailed view of part of FIG. 2.

FIG. 3 shows a cross-section of the plate, on which the plateaus created by the obstacles (11), as well as the ducts (10), can be seen. This shows that the plateaus of said obstacles lie in the same plane as the upper face of the side edge of the plate.

In view of the possible variation in the thickness of the plate, of the depth and of the width of the machining profile, and of the shape and of the arrangement of the obstacles, it is thus possible to create plates adapted to various types of heat transfer, and in particular to monophase or biphase transfer.

In addition, it is possible to vary the profile in one and the same face of a plate as a function of the alteration, or, on the other hand, of the conservation of the desired phase. This developed profile therefore makes it possible to adapt each heat exchanger to the type of heat transfer which it is supposed to ensure, with the aim of optimum efficiency.

According to an advantageous feature of the invention, also shown in FIG. 5, the bearing points consisting of the obstacles of two adjacent plates are offset in a honeycomb structure, so as to present a larger regular average thickness between two adjacent ducts receiving one and the same type of fluid, that is to say cold fluid or hot fluid. The mechanical strength of the plates is thereby reinforced. On the other hand, in this embodiment, two adjacent ducts in which two different fluids circulate have an offset structure.

In contrast, FIG. 6 shows a region with minimum passage cross-section, that is to say an acceleration region of the fluid which is intended, as already specified, to make the heat exchange more intense.

The plates thus produced give the resulting exchanger thermodynamic performances which are very greatly enhanced compared to plate exchangers hitherto known.

The use of graphite plays a great part in this increase in efficiency, as does the adoption of a particular profile, making it possible, by the creation of turbulence, by the increase of some of the heat exchange and by the creation of acceleration regions of the fluid, and finally by the expedient choice of the profile of the obstacles, to optimize the heat exchanges, without thereby impairing the circulation of the fluid in the ducts.

We claim:

1. A plate heat exchanger with parallel and counterflow circulation of heat-exchange fluids, said heat exchanger comprising:

a stack of a predetermined number of ribbed plates of the same size, the plates of said stack being clamped against one another between two flanges, said ribbed plates having openings in their corners defining, within the stack, respective supply and outlet channels for the heat-exchange fluids, the plates being made of bulk graphite, previously impregnated with a resin waterproofing material, said stack of ribbed plates further including a system of ducts between each pair of adjacent plates, said system of ducts fluidly connecting said respective supply and outlet channels and each duct of said system of ducts varying in cross-sectional dimensions between the channels to control acceleration of the heat exchange fluids and optimize the rate of heat exchange, wherein at least one of two faces of each of the plates has a profile including:

distribution regions A consisting of a plurality of half-ducts extending substantially radially over a sector between two openings of the plate corresponding to said respective supply and outlet channels, said half-ducts being formed by a machining process; and a heat-exchange region B, connecting the two distribution regions A and including a plurality of machining-formed obstacles to the progression of the fluid circulating between two adjacent plates, thereby forming said system of ducts and points of bearing of one respective plate on the immediately adjacent plate.

2. The plate exchanger as claimed in claim 1, wherein the upper surface of each of the obstacles of the heat-exchange regions B is planar, and the upper surface of each of said obstacles is contained in one and the same plane, which plane furthermore incorporates the upper surface of the side edge of the plate.

3. The plate exchanger as claimed in claim 1, wherein the obstacles of the heat-exchange region B have an ellipse, flame, "S", crescent or teardrop shape.

4. The plate exchanger as claimed in one of claim 1, wherein the obstacles are distributed in a triangular or square network.

5. The plate exchanger as claimed in claim 1, wherein the local cross-sectional variations of the ducts are obtained by the arrangement of the obstacles and/or by the variation of their depth.

6. The plate exchanger as claimed in claim 1, wherein the circulation ducts of one type of heat-exchange fluid, generated by the stacking of the plates, are exactly superposed over the entire height of the stack, so that the obstacles which define them are also superposed, the circulation ducts of one given fluid being offset in height with respect to the circulation ducts of the other fluid.

* * * * *